US012544640B1

(12) United States Patent
Daley

(10) Patent No.: US 12,544,640 B1
(45) Date of Patent: Feb. 10, 2026

(54) BASEBALL SWING TRAINING DEVICE

(71) Applicant: Brian Daley, St. Augustine, FL (US)

(72) Inventor: Brian Daley, St. Augustine, FL (US)

( * ) Notice: Subject to any disclaimer, the term of this patent is extended or adjusted under 35 U.S.C. 154(b) by 137 days.

(21) Appl. No.: 17/987,937

(22) Filed: Nov. 16, 2022

Related U.S. Application Data

(60) Provisional application No. 63/279,723, filed on Nov. 16, 2021.

(51) Int. Cl.
*A63B 69/36* (2006.01)
*A63B 69/00* (2006.01)

(52) U.S. Cl.
CPC ..... *A63B 69/0002* (2013.01); *A63B 69/0059* (2013.01); *A63B 2069/0008* (2013.01); *A63B 2225/09* (2013.01)

(58) Field of Classification Search
CPC ..... A63B 69/0002; A63B 69/0059; A63B 2069/0008; A63B 2225/09
USPC ..... 473/212–214, 451, 453, 458
See application file for complete search history.

(56) References Cited

U.S. PATENT DOCUMENTS 5,040,798 A * 8/1991 Leitao ..... A63B 69/0059 473/212
5,085,437 A * 2/1992 Leitao ..... A63B 69/0059 473/212
5,114,142 A 5/1992 Gillespie et al.
5,203,567 A * 4/1993 Erlinger ..... A63B 69/3676 473/276
5,529,306 A 6/1996 Staats et al.
5,697,873 A * 12/1997 Van Straaten ..... A63B 23/0488 482/122
5,902,189 A 5/1999 Schultz
5,938,548 A * 8/1999 Upshaw ..... A63B 69/0059 473/453
6,332,845 B1 * 12/2001 Priestley ..... A63B 69/0057 473/409
6,901,931 B2 * 6/2005 Turesin ..... E05B 75/00 128/845
6,976,942 B2 * 12/2005 Kennedy ..... A63B 21/0552 482/125
7,033,282 B1 4/2006 Flood
9,662,559 B2 * 5/2017 Strand ..... A63B 69/0057
2003/0109320 A1 6/2003 Perry
2004/0058757 A1 * 3/2004 Gray ..... A63B 21/4017 473/458
2005/0009647 A1 * 1/2005 Gray ..... A63B 69/0059 473/458

(Continued)

FOREIGN PATENT DOCUMENTS

KR 100817500 B1 3/2008

*Primary Examiner* — Nini F Legesse
(74) *Attorney, Agent, or Firm* — John Rizvi; John Rizvi, P.A.—The Patent Professor®

(57) ABSTRACT

The present invention is directed to a baseball swing training device that helps batters perfect their swing mechanics when hitting a baseball or a softball. The baseball swing training device may include an elongate member and a plurality of protrusions extending from the elongate member. The elongate member may be length-adjustable, such as by including a locking mechanism which may engage with a plurality of apertures, such that the extendable device may accommodate users of various wingspans. The device assists in providing balance to a batter by getting their top hand elbow into the slot, while keeping their bottom hand elbow soft.

14 Claims, 5 Drawing Sheets

(56) References Cited

U.S. PATENT DOCUMENTS

| | | | | |
|---|---|---|---|---|
| 2006/0154738 | A1 | 7/2006 | Larsen | |
| 2008/0026863 | A1* | 1/2008 | Eck | A63B 69/3623 473/212 |
| 2009/0143204 | A1* | 6/2009 | Gronda | A63B 23/1254 482/112 |
| 2009/0197692 | A1* | 8/2009 | Eck | A63B 69/3608 473/409 |
| 2013/0324331 | A1 | 12/2013 | Barnhill | |
| 2017/0252629 | A1 | 9/2017 | Becktell | |
| 2017/0361194 | A1 | 12/2017 | Strand et al. | |
| 2020/0061432 | A1* | 2/2020 | Springman | A63B 69/0059 |

* cited by examiner

BASEBALL SWING TRAINING DEVICE

CROSS-REFERENCE TO RELATED APPLICATION

This application claims the benefit of U.S. Provisional Patent Application No. 63/279,723, filed on Nov. 16, 2021, which is incorporated herein by reference in its entirety.

FIELD OF THE INVENTION

The present invention relates generally to an apparatus for athletic equipment. More particularly, the present invention relates to a baseball swing training device that is configured to assist in training an athlete in the preferred mechanics of swinging a baseball bat. The device may be configured to be extendable to accommodate the relative size over various athletes.

BACKGROUND OF THE INVENTION

Baseball is a sport that is often considered to be "America's Pastime". It is a game that is very common for kids to learn at a young age. Youth leagues, often called "Little Leagues", are a very common way to introduce kids to the game. When it comes to baseball practice, there are hundreds of drills and variations a team or coach can choose from. However, because hitting is such a critical part of the game, many coaches focus on training their players on hitting mechanics.

In baseball, hitting mechanics refers to the study of the biomechanical motion than governs the swing of a baseball player. The goal of biomechanics in hitting with respect to baseball training is to study and improve upon the physics involved in hitting a baseball. This may include, for instance, optimizing a player's swing for either improving their bat speed or plate coverage. Players may exhibit a wide array of batting stances and mechanics that are developed through individual preferences; however, many believe that from a biomechanical perspective, there are correct and incorrect ways to how a hitter swings.

Hitters have a wide variation of swings; however, many coaches tend to agree that being balanced and having a stable posture are among the most important aspects of hitting a baseball. If a hitter becomes unbalanced at any point throughout the swing, the chances of making strong contact with the baseball diminish. Another important aspect to hitting is bat speed. Studies have shown that the faster the bat speed, the faster the ball will travel upon contacting the bat. Bat speed may also be a function of balance and posture.

From an anatomical standpoint, a player's grip and position, both before and during a swing, is very important to achieving balance and a strong bat speed. Batters typically line up their middle knuckles on the bat so that their hands are in the steadiest position possible. If the knuckles are not in a stabilizing position, the bat may tend to jump in the hands as the batter turns their wrists to finish their swing. Additionally, it is also recommended that the player keep their back elbow up and close to the body throughout the swing. There presently aren't any devices known to help aide a batter in perfecting their hitting mechanics and swing sequence.

Accordingly, there remains a need in the art for a solution to at least one of the aforementioned problems. For instance, a baseball swing training device that assists batters in perfecting their swing mechanics is desired. More particularly, the device desired should help prevent casting of the bat, prevent swinging around the ball, and prevent rolling of the hands throughout the swing. Additionally, it is also desired that the device be able to be modulated for use of athletes of all sizes.

SUMMARY OF THE INVENTION

The present invention is directed to a baseball swing training device that helps batters perfect their swing mechanics when hitting a baseball or a softball. The baseball swing training device may include an elongate member and a plurality of protrusions extending from the elongate member. The elongate member may be comprised of at least two shorter segments wherein once encases the other. Each of the segments may have a plurality of apertures that allow the elongate member as a whole to be extendable. The plurality of protrusions may be configured to be placed about the indie elbow of a batter while a batter is batting or swinging at a baseball.

The baseball swing training device may solve a number of problems athletes may have with their swing. Firstly, the device assists in providing balance to a batter by getting their top hand elbow into the slot, while keeping their bottom hand elbow soft. Secondly, the positioning provided by the device provide a good hand path for a batter to hit the ball at the barrel of the bat. Thirdly, the device helps keep a batter's bottom hand up and top hand down, preventing rollover in the swing sequence. Lastly, the device assists in preventing a batter from swinging around the ball and assists in ensuring a powerful kinetic movement, from a biomechanical standpoint, to the point of contact.

In a first implementation of the invention, a baseball swing training device comprises:

an elongate member;

at least two protrusions extending from the elongate member; wherein the at least two protrusions are configured to be placed about the inside elbows of a batter while swinging at a ball.

In a second aspect, the elongate member may be comprised of a first segment and a second segment.

In another aspect, at least part of the first segment may be configured to be placed within the second segment.

In another aspect, both the first segment and the second segment of the elongate member may be tubular in shape.

In another aspect, the diameter of the first segment may be smaller than the diameter of the second segment.

In another aspect, both the first segment and the second segment may each have a plurality of apertures.

In another aspect, each of the plurality of apertures may be evenly spaced apart from each other.

In another aspect, each of the plurality of apertures may each have the same diameter.

In another aspect, the first segment may include a locking mechanism.

In another aspect, the locking mechanism may be configured to mate the first segment to the second segment.

In another aspect, the locking mechanism may be sized and configured to fit into the plurality of apertures.

In another aspect, the locking mechanism may be depressible to unlock the first segment from the second segment.

In another aspect, the plurality of apertures in conjunction with the locking mechanism may be configured such that the elongate member is extendable.

In another aspect, the at least two protrusions may each extend from a portion of both the first segment and the second segment.

In another aspect, each of the at least two protrusions may be curved.

In another aspect, each of the at least two protrusions may be L-shaped.

In another aspect, the at least two protrusions may be inverted with respect to each other.

In another aspect, the at least two protrusion may each included a padding.

In another aspect, the padding may be circular in shape.

In another aspect, each of the at least two protrusions may be spaced apart evenly from each respective end of the elongate member.

In another aspect, each of the at least two protrusions may be equal in length.

In another implementation of the invention, a method of operating a baseball swing training device comprises:

obtaining a baseball swing training device, the swing training device including an elongate member having at least two protrusions extending from the elongate member, the elongate member further comprising a first segment and a second segment, wherein both the first segment and the second segment include a plurality of apertures;

placing an end of the second segment into the first segment and adjusting a length of the elongate member;

locking the second segment into the first segment through one of the plurality of apertures; and placing the at least two protrusions about the inside elbows of a batter such that the elongate member rests above the arms of the batter.

In another aspect, the method may further include the step of having the batter swing at a pitch.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a baseball swing training device that is designed and configured to assist batters in improving and perfecting their swing mechanics. Shown throughout the figures is at least one illustrative embodiment of the invention. The baseball swing training device of the present disclosure may include an elongate member and at least two protrusions extending from the elongate member. The protrusions may be configured to sit about an inside portion of a batter's elbows while practicing their swing. While the device is designed and configured with the sport of baseball and softball in mind, its use may extend to any bat-and-ball or club-and-ball sport such as, but not limited to, cricket and golf.

Figure 1:
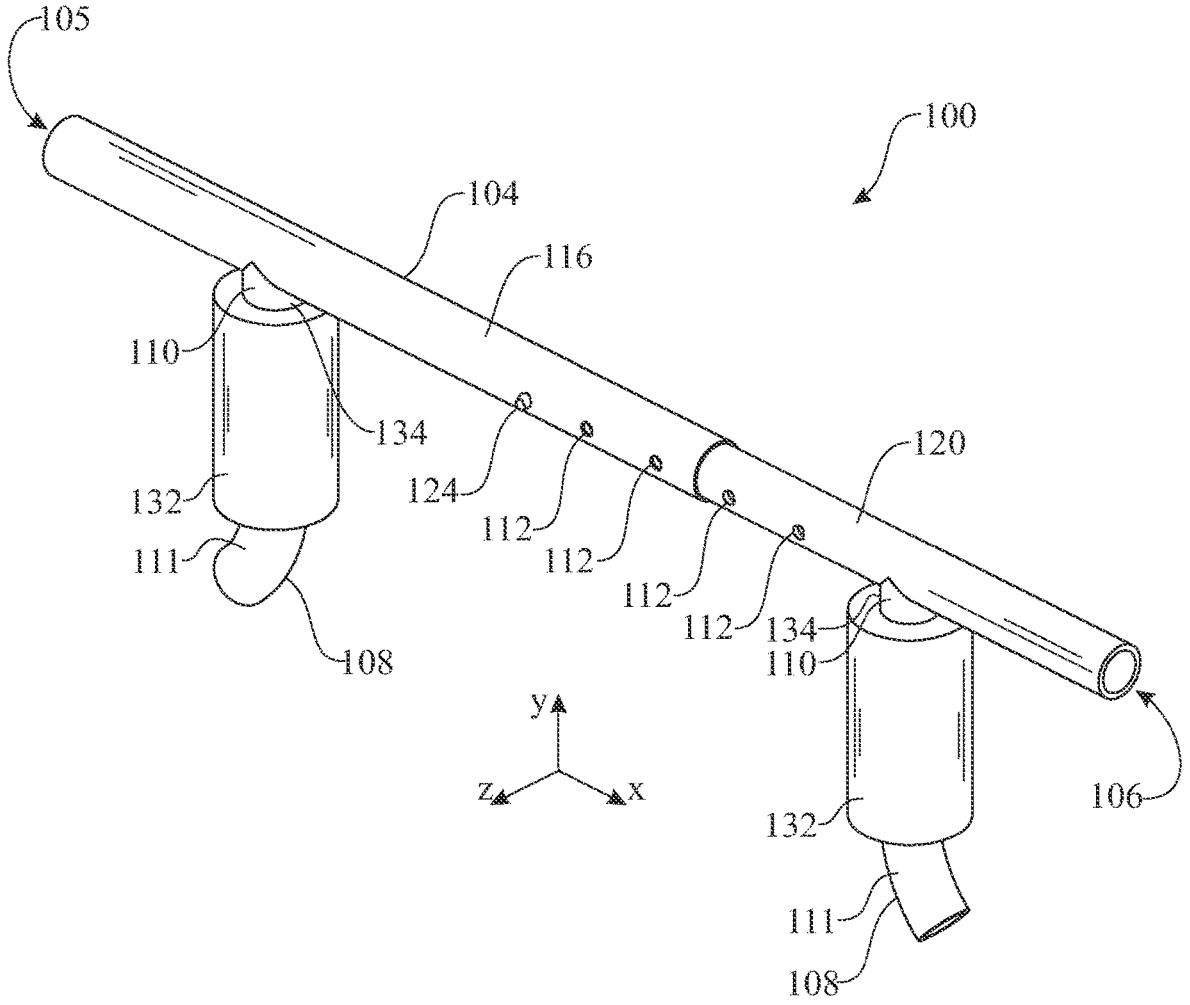
FIG. 1 presents a front perspective view of a baseball swing training device in accordance with a first illustrative embodiment of the invention.

Referring initially to FIG. 1, a baseball swing training device 100 is illustrated in accordance with an exemplary embodiment of the present invention. As shown, the baseball swing training device 100 comprises an elongate member 104 having a proximal end 105 and a distal end 106. The elongate member 104 may be elongately formed along a longitudinal or first direction x. In some embodiments, such as the present embodiment, the elongate member 104 may be generally straight. In preferred embodiments, the elongate member 104 is generally rigid or non-flexible.

The baseball swing training device 100 may further include at least two tubular portions or protrusions 108 extending from the elongate member 104, such as from a bottom side thereof, as will be described in greater detail hereinafter. The protrusions 108 may be generally cylindrical, as shown, i.e. may have a generally circular cross-section. In some embodiments, the at least two protrusions 108 may be generally rigid or non-flexible. The at least two protrusions 108 may extend along a second direction y, which may be generally perpendicular to the first direction x. For example, in the orientation or position shown in FIG. 1, the second direction y is generally vertical, and the at least two protrusions 108 extend vertically downward from the elongate member 104.

With continued reference to FIG. 1, the baseball swing training device 100 may further include a plurality of apertures 112 about a central portion of the elongate member 104, wherein the plurality of apertures 112 are configured to modulate the length of the elongate member 104. As shown, the plurality of apertures 112 may be formed in discrete positions along the elongate member 104, such as aligned with and spaced-apart, such as evenly spaced-apart, from one another along the longitudinal direction x. In some embodiments, such as the present embodiment, the plurality of apertures 112 may be oriented transversely, i.e. in a transverse or third direction z generally perpendicular to the first and second directions x and y, such that the apertures 112 are generally formed on an r-y plane or generally perpendicular to the third direction z. For example, in the depicted example, the apertures 112 face sideways, perpendicularly to the downward protrusions 108, which in turn are generally perpendicular to the longitudinal, elongate member 104. The plurality of apertures 112 may have the same diameter relative to one another.

Figure 2:
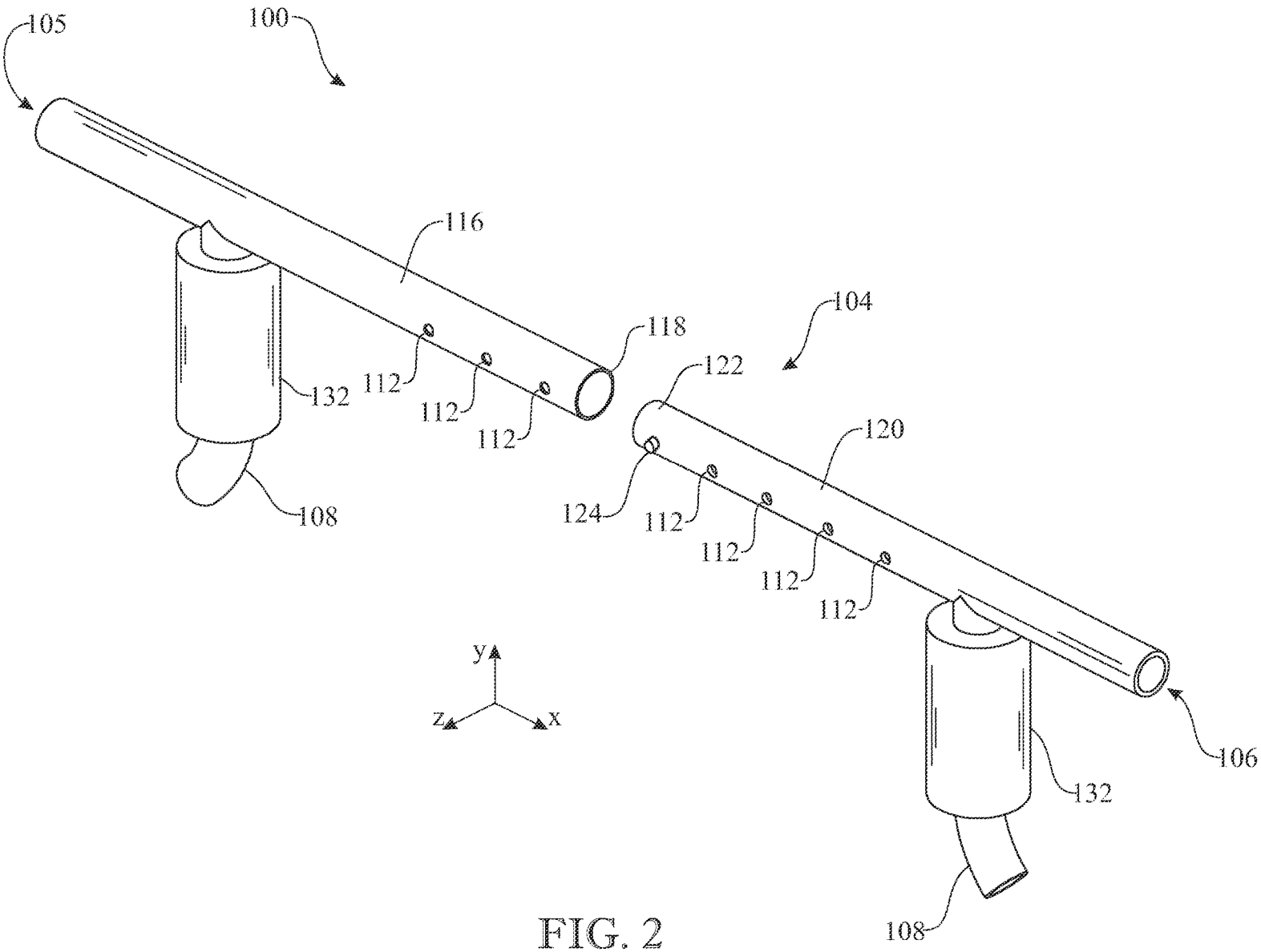
FIG. 2 presents an exploded front perspective view of the baseball swing training device illustrated in FIG. 1.

Referring now to FIG. 2, the elongate member 104 may be comprised of a first segment 116 and a second segment 120. Both the first segment 116 and the second segment 120 of the elongate member 104 may be cylindrical in shape. The first and second segments 116 and 220 may be telescopically connected to one another, with the second segment 120 slidably received within the first segment 116 and selectively extendable from and retractable into the first segment 116. The outer diameter of the second segment 120 may be smaller than the inner diameter of the first segment 116, facilitating the slidable arrangement of the second segment 120 within the first segment 116. In some embodiments, the second segment 120 may be solid; in other embodiments, such as the present embodiment, the second segment 120 may be hollow. The first segment 116, in turn, may be generally hollow for slidably and telescopically receiving the second segment 120. In some embodiments, both the first segment 116 and the second segment 120 may be made of polyvinyl chloride (PVC) piping or other similar materials. Both the first segment 116 and the second segment 120 may each include the aforementioned plurality of apertures 112 on a central portion of each segment 116, 120.

Figure 3:
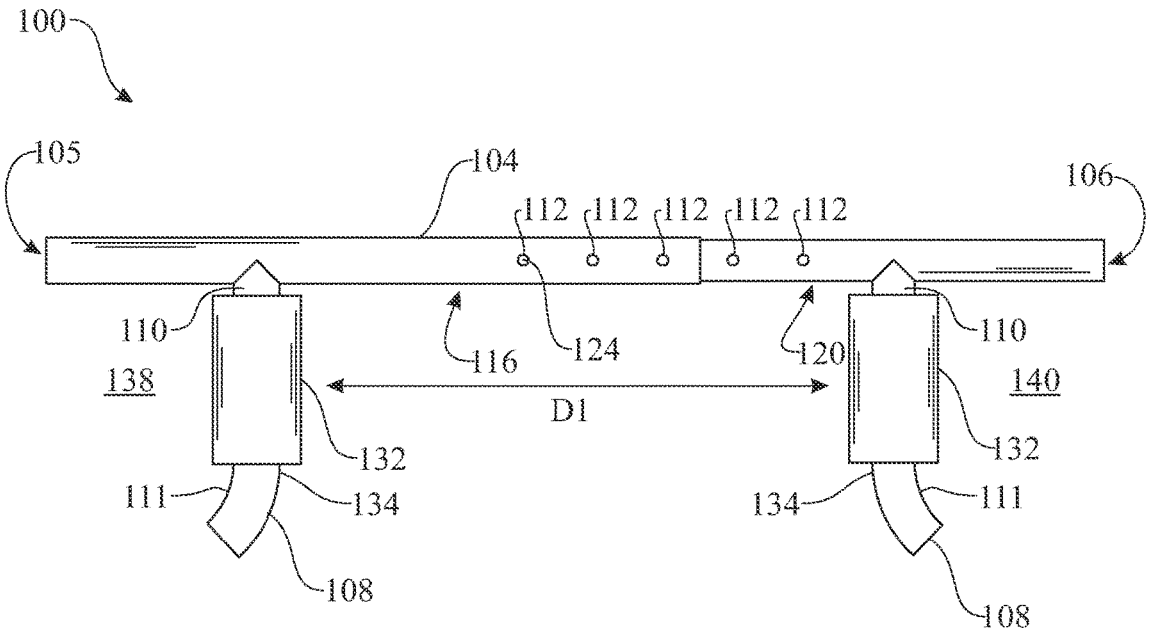
FIG. 3 presents a front elevation view of the baseball swing training device illustrated in FIG. 1, shown prior to the device being extended.
Figure 4:
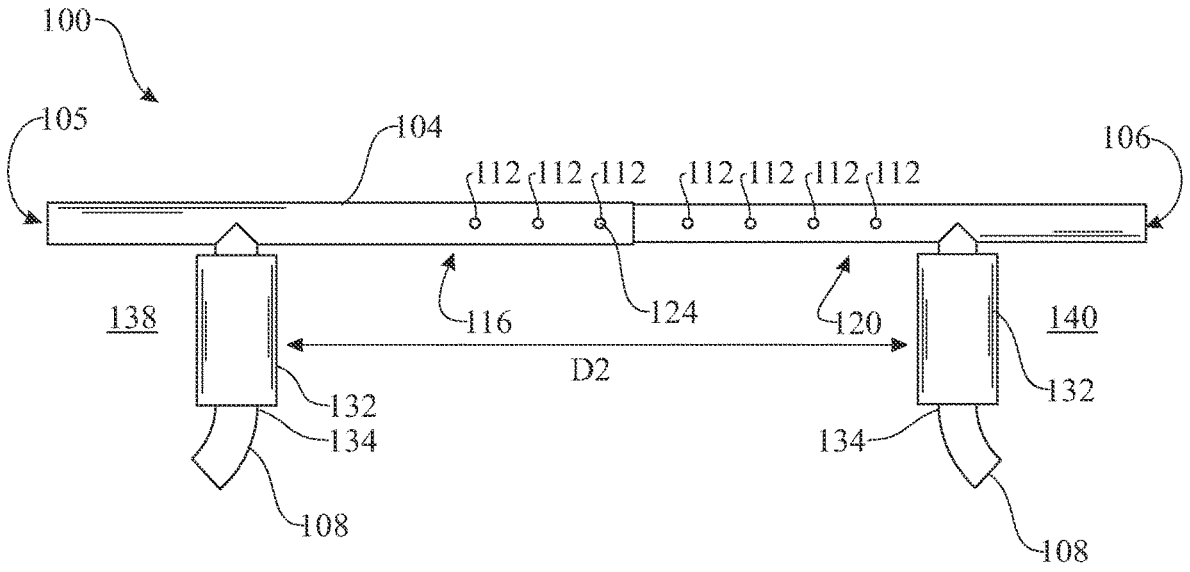
FIG. 4 presents a front elevation view of the baseball swing training device illustrated in FIG. 3, shown after the device is extended.

With continued reference to FIG. 2, the second segment 120 may include a locking mechanism 124. The locking mechanism 124 may be included on an end portion of the second segment 120, adjacent to the plurality of apertures 112. The locking mechanism 124 may be configured to mate the second segment 120 to the first segment 116, i.e. lock the second segment 120 in a selected slidable position relative to the first segment 116. More particularly, the locking mechanism 124 may be configured to fit within any of the plurality of apertures 112 of the first segment 116. The locking mechanism 124 may be depressible so as to disengage from the apertures 112 and thereby unlock the first segment 116 from the second segment 120 and allow the first and second segments 116, 120 to slide relative to one another. For instance, in some embodiments, such as the present embodiment, the locking mechanism 124 may include a spring-loaded ball configured to selectively engage with each aperture 112 of the plurality of apertures 112. As best shown in FIGS. 3 and 4, the plurality of apertures 112 in conjunction with the locking mechanism 124, together with the telescopically-positionable first and second segments 116 and 120, may be configured to allow the elongate member 104 to be adjusted to different lengths, and locked at each different length. In this way, the separation between the protrusions 108 may be adjusted.

For example, in a first illustrative adjustment, shown in FIG. 3, the first and second segments 116 and 120 of the elongate member 104 have been telescopically adjusted to a relative position such that the elongate member 104 is compressed and the protrusions 108 are separated from one another a relatively small, first distance D1. The elongate member 104 is locked in this first illustrative position by the locking mechanism 124 being coupled with the aperture 112 of the first segment 116 closest to the proximal end 105 of the elongate member 104. In a second illustrative embodiment, shown in FIG. 4, the first and second segments 116 and 120 of the elongate member 104 have been moved longitudinally and telescopically away from one another to extend the elongate member 104 such that the protrusions 108 are separated from one another a second distance D2 which is greater than the first distance D1. The elongate member 104 is locked in this second illustrative position by the locking mechanism 124 being coupled with the aperture 112 of the first segment 116 closest to the distal end 106 of the elongate member 104. It should be noted that, in some embodiments, such as the present embodiment, further adjustments are possible by selectively coupling the locking mechanism 124 with intermediate apertures 112 of the first segment 116 (e.g., the central aperture 112 of the three apertures 112 provided in the first segment 116 of the present embodiment).

With continued reference to FIGS. 1-3, attention is directed to the at least two protrusions 108 carried by the elongate member 104. In some embodiments, such as the present embodiment, each one of the first segment 116 and the second segment 120 of the elongate member 104 may include at least one protrusion 108 of the at least two protrusions 108; for example, the present embodiment specifically includes a single respective protrusion 108 carried by each one of the first and second segments 116 and 120. In some embodiments, such as the present embodiment, at least one protrusion 108 may from a bottom portion of each of the first segment 116 and the second segment 120; for instance, in the present embodiment, the specific, single protrusion 118 of each one of the first and second segments 116 and 120 extends from a bottom side of the corresponding first or second segment 116, 120.

In some embodiments, such as the present embodiment, each protrusion 108 may include a first portion 110 and a second portion 111, arranged along different directions with respect to one another, and the protrusion 108 may thereby be curved or L-shaped. For example, the protrusions 108 shown herein are generally curved, with the first portion 110 being generally straight (arranged for instance in the second direction y) and the second portion 111 formed slightly curved and extending from the first portion 110 in a different direction with respect to the first portion 110.

In some embodiments, the at least two protrusions 108 may be inverted or symmetrical with respect to each other, as best shown in FIG. 3. Alternatively or additionally, the protrusions 108 may extend away from one another; for example, in the present embodiment, the first portions 110 of the protrusions 108 are generally parallel and the second portions 111, in turn, extend away from one another. In some embodiments, such as the present embodiment, the distance between the distal end 105 of the elongate member 104 and the protrusion 108 arranged adjacent to the distal end 105 may be the same as the distance between the proximal end 106 of the elongate member 104 and the protrusion 108 arranged adjacent to the proximal end 106.

The at least two protrusions 108 may be equal in length. For example, in some embodiments, such as the present embodiment, the first portions 110 of the protrusions 108 are equal in length, and the second portions 111 of the protrusions 108 are equal in length. In some embodiments, the first portions 110, which may be straight, are longer than the second portions 111; for example, the first portions 110 of the present embodiment are about twice as long as the second portions 111.

In some embodiments, the at least two protrusions 108 may include a padding 132. The padding 132 of each protrusion 108 may extend at least partially around the protrusion 108, and may cover at least an inner side 134 of the protrusion 108 which faces the inner side 134 of the other protrusion 108, such that said inner sides 134 of the protrusions 108 facing one another are padded or cushioned. In some embodiments, such as the present embodiment, the padding 132 may further extend around the entire periphery of the protrusion 108; for example, as shown, the padding 132 may be tubular and may have an outer cylindrical shape. The padding 132 may provide a cushioning effect for purposes described hereinafter. In some embodiments, such as the present embodiment, the padding 132 may be arranged at the first portion 110, and optionally further along the second portion 111 of the protrusion 108.

Referring now to FIGS. 2-6, a method of operating the baseball swing training device 100 is shown. Referring initially to FIG. 2, a user may begin by assembling the elongate member 104 of the baseball swing training device 100. Assembly may commence by inserting an end 122 of the second segment 120, which includes the locking mechanism 124, into an open end 118 of the first segment 116, which includes the plurality of apertures 112. Such an arrangement ensures that the proximal end 105 and the distal end 106 of the elongate member 104 are configured appropriately, as will be described in greater detail hereinafter. Upon placing a portion of the first segment 116 into the second segment 120, a user may adjust the length of the elongate member 104 and the corresponding separation between the protrusions 108, as described heretofore with reference, for instance, to FIGS. 3 and 4. Once the desired length and separation has been achieved, a user may lock the first segment 116 into place with the second segment 120 by aligning and engaging the locking mechanism 124 of the second segment 120 with the desired aperture of the plurality of apertures 112 of the first segment 116, as described heretofore.

It should be noted that, during the extension and retraction of the telescopic elongate member 104 in order to engage the locking mechanism 124 with the desired aperture 112 of the first segment 116, the aperture or apertures 112 provided in the second segment 120, in turn, may serve as a visual reference as to the position of the locking mechanism 124 as the locking mechanism 124 advances through the first segment 116. This may facilitate a more rapid connection of the locking mechanism 124 into the desired aperture 112 of the first segment 116 and a more intuitive adjustment of the protrusions 108 to the corresponding, selected separation from one another.

Figure 5:
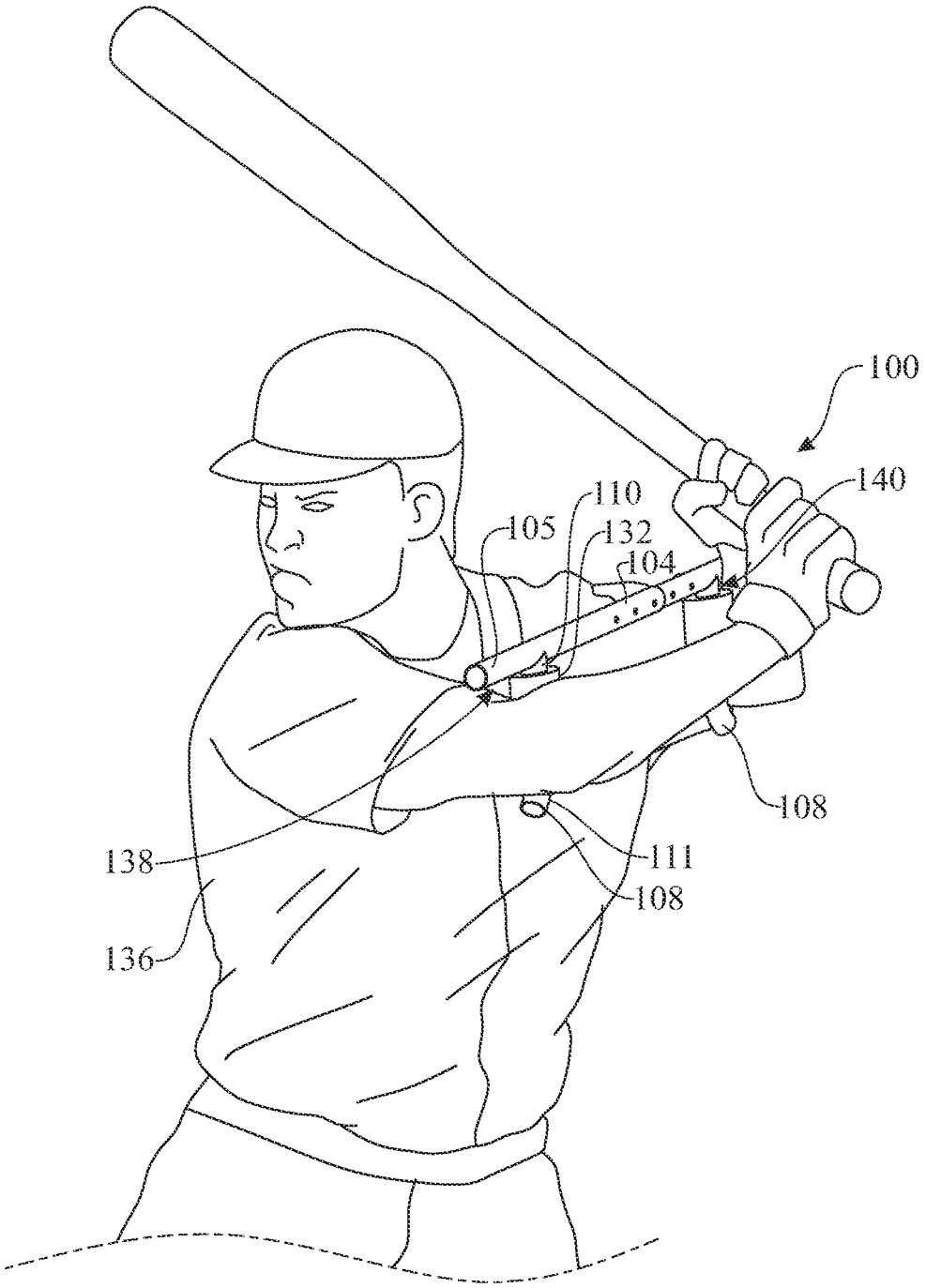
FIG. 5 presents a front perspective view of the baseball swing training device illustrated in FIG. 1, shown in use by a batter prior to swinging.

Referring now to FIG. 5, upon assembly of the elongate member 104, the baseball swing training device 100 may be ready for use. The intended user may be a batter 136 preparing to swing a baseball or a softball bat. As such, the first step may be for the batter 136 to place the two protrusions 108 of the baseball swing training device 100 about their inside elbows, such that the protrusions 108 are arranged between the arms of the user. In preferred embodiments, the inside elbows of the batter 136 may rest on the padding 132 encasing the protrusions 108. Furthermore, the curved, second portions 111 may wrap around the arms and thereby contribute to maintain the baseball swing training device 100 in place relative to the arms. In turn, the padding 132 may not only provide comfort to the user, but also an increased friction and thereby a greater stabilization of the baseball swing training device 100 relative to the arms of the batter 136.

Figure 6:
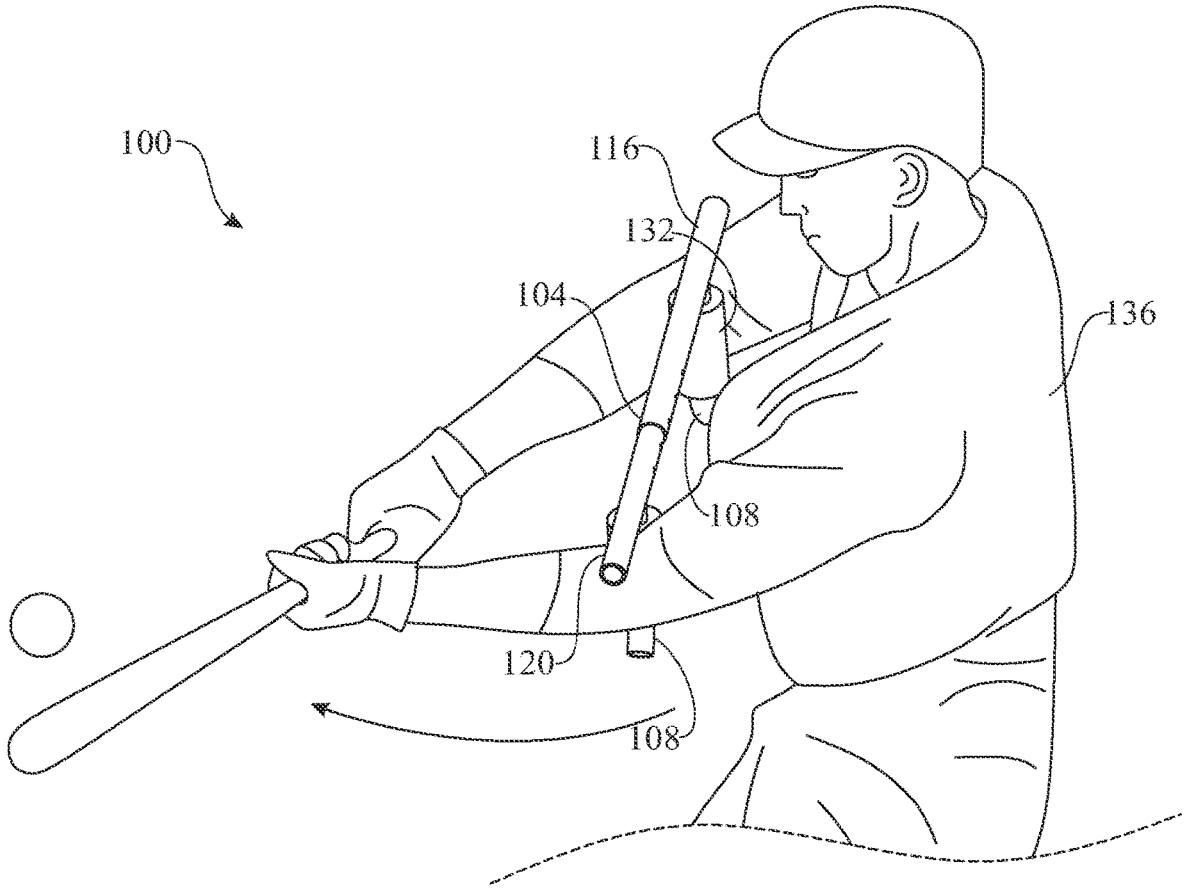
FIG. 6 presents a front perspective view of the baseball swing training device illustrated in FIG. 5, shown in use by the batter while swinging.

Such a configuration should allow the elongate member 104 of the baseball swing training device 100 to extend above and at least partially over, or across a top of, the arms of the batter 136. More particularly, the proximal end 105 of the elongate member 104 lies above one arm, such that said one arm is at least partially received within a first space 138 (FIG. 3) defined between the proximal end 105 of the elongate member 104 and the adjacent protrusion 108. Similarly, the distal end 106 of the elongate member 104 lies above the other arm of the batter 136, such that said other arm is at least partially received within a second space 140 (FIG. 3) defined between the distal end 106 of the elongate member 104 and the adjacent protrusion 108. At this point, the batter 136 may be prepared to swing at a ball pitched to him/her, as best shown in FIG. 6. The training device 100 assists in allowing the batter 136 to maintain a balanced swing by getting their top hand elbow into the slot, while keeping their bottom hand elbow soft. This positioning may allow for the batter 136 to create the most optimal path to hitting the ball by increasing the likelihood that the barrel of the bat strikes the ball. Lastly, the baseball swing training device 100 helps keep a batter's bottom hand up and top hand down, preventing rollover in the swing sequence.

Alternative embodiments are contemplated to those shown or described herein without departing from the scope of the present disclosure. For example, embodiments are contemplated in which the device may include straps or other fastening mechanism to ensure that the device on top of a user's arms and within the right positions of the elbows. Another alternative embodiment considered is potentially allowing the protrusions to be removable from the elongate member so as to allow further modulation of the device. Lastly, embodiments are envisioned in which the device is reconfigured for use in other sports such as cricket, golf, and other sports depending on the desired positioning needed.

In summary, the baseball swing training device disclosed herein provides a device which utilizes assists batter in having a more balanced swing as they hit a baseball or a softball. This may be achieved by helping the batter maintain their top hand elbow into the slot, while keeping their bottom hand elbow soft. The positioning provided by the device provides a good hand path for a batter to hit the ball at the barrel of the bat and helps in preventing rollover in the swing sequence. Lastly, the device assists in preventing a batter from swinging around the ball and assists in ensuring a powerful kinetic movement, from a biomechanical standpoint, to the point of contact.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A baseball swing training device comprising:

an elongate member having a proximal end and an opposite distal end, the elongate member extending straight along a longitudinal axis between the proximal end and the distal end, the elongate member being length-adjustable and comprising a first segment and a second segment slidable relative to the first segment; and a first protrusion and a second protrusion fixedly attached to the first segment and the second segment of the elongate member respectively, each of the first and second protrusion extending from between the proximal end and the distal end of the elongate member from the first segment and the second segment respectively, the first and second protrusions arranged in spaced-apart relationship with one another;

a locking mechanism configured to releasably lock the second segment to the first segment in a selected slidable position relative to the first segment, and consequently, lock the first protrusion at selected distance from the second protrusion; wherein the first and second protrusions each comprise a respective first portion extending perpendicularly from the elongate member, and a respective second portion extending from the respective first portion along a different direction relative to the respective first portion, a first space is defined between a proximal end of the elongate member and the first protrusion, a second space is defined between the distal end of the elongate member and the second protrusion, the baseball swing training device is configured to adopt a working configuration in which the first segment and the second segment, along with the first protrusion and second protrusion are maintained in place and locked relative to one another by the locking mechanism and each one of the first and second protrusions abuts against an inside elbow of a respective arm of a batter while swinging at a ball, in the working configuration, first and second arms of the batter are located at the first and second spaces, respectively, and the baseball swing training device is configured to adopt a non-working configuration in which the first segment and the second segment, along with the first protrusion and second protrusion, are unlocked relative to one another by the locking mechanism so as to enable varying the distance between the first and second protrusions by sliding the first segment and the second segment relative to each other.

2. The baseball swing training device of claim 1, wherein each one of the first and second protrusions comprises a respective padding providing an outer cushioning to at least a respective inner side of said each one of the first and second protrusions, the respective inner side of said each one of the first and second protrusions facing the inner side of the other of the first and second protrusions, and further wherein, in the working configuration, the respective paddings abut against the respective inside elbows of the batter.

3. The baseball swing training device of claim 2, wherein the respective padding of said each one of the first and second protrusions extends around an entire periphery of said each one of the first and second protrusions.

4. The baseball swing training device of claim 1, wherein the first segment and the second segment are telescopically connected to one another to vary the length of the elongate member.

5. The baseball swing training device of claim 1, wherein the locking mechanism is carried by one of the first and second segments and is configured to selectively engage with a plurality of apertures formed in the other of the first and second segments, the plurality of apertures formed in spaced-apart relationship with one another.

6. The baseball swing training device of claim 5, wherein said one of the first and second segments comprises another plurality of apertures, wherein said another plurality of apertures are arranged in spaced-apart relationship with one another and aligned with the locking mechanism and the plurality of apertures of the other of the first and second segments.

7. The baseball swing training device of claim 1, wherein the first and second protrusions are generally cylindrical.

8. The baseball swing training device of claim 1, wherein the first portions of the first and second protrusions are generally parallel to one another.

9. The baseball swing training device of claim 8, wherein the first portions are generally straight.

10. The baseball swing training device of claim 8, wherein the first portions extend from a same side of the elongate member.

11. The baseball swing training device of claim 1, wherein in the working configuration, the second portions wrap around the arm of the batter below the inside elbows.

12. The baseball swing training device of claim 11, wherein the second portion of each one of the first and second protrusions is curved away from the other of the first and second protrusions.

13. The baseball swing training device of claim 11, wherein the second portions of the first and second protrusions extend away from each other.

14. A baseball swing training device comprising:

an elongate member having a proximal end and an opposite distal end, the elongate member extending straight along a longitudinal axis between the proximal end and the distal end, the elongate member being length-adjustable and comprising a first segment and a second segment slidable relative to the first segment; and a first protrusion and a second protrusion fixedly attached to the first segment and the second segment of the elongate member respectively, each of the first and second protrusion extending from between the proximal end and the distal end of the elongate member from the first segment and the second segment respectively, the first and second protrusions arranged in spaced-apart relationship with one another, wherein a first space is defined between the proximal end of the elongate member and the first protrusion, and further wherein a second space is defined between the opposite, distal end of the elongate member and the second protrusion; and a locking mechanism configured to releasably lock the second segment to the first segment in a selected slidable position relative to the first segment, and consequently, lock the first protrusion at selected distance from the second protrusion; wherein each one of the first and second protrusions comprises a respective first portion extending perpendicularly form the elongate member and a respective second portion extending from the respective first portion along a different direction relative to the respective first portion; wherein each one of the first and second protrusions comprises a respective padding providing an outer cushioning to at least a respective inner side of said each one of the first and second protrusions, the respective inner side of said each one of the first and second protrusions facing the inner side of the other of the first and second protrusions; and further wherein the baseball swing training device is configured to adopt a working configuration in which the first segment and the second segment, along with the first protrusion and second protrusion are maintained in place and locked relative to one another by the locking mechanism, first and second arms of the batter are located at the first and second spaces, respectively, and the respective paddings abut against an inside elbow of a respective arm of a batter while swinging at a ball with the arms of the batter located at the first and second spaces, respectively, while the second portions wrap around the arms of the batter below the inside elbows, and the baseball swing training device is configured to adopt a non-working configuration in which the first segment and the second segment, along with the first protrusion and second protrusion, are unlocked relative to one another by the locking mechanism so as to enable varying the distance between the first and second protrusions by sliding the first segment and the second segment relative to each other.

* * * * *